United States Patent [19]

Erana

[11] Patent Number: 5,007,477

[45] Date of Patent: Apr. 16, 1991

[54] AIR IMPACT SAND-BOX MOULDING MACHINE

[76] Inventor: Agustin A. Erana, Zorrostea, 4 Polígono Ind. Alí-Gobeo, 01010 Vitoria Alava, Spain

[21] Appl. No.: 503,611

[22] Filed: Apr. 3, 1990

[30] Foreign Application Priority Data

Apr. 6, 1989 [ES] Spain ..... 8901201

[51] Int. Cl.[5] ..... B22C 15/00

[52] U.S. Cl. ..... 164/169; 164/37

[58] Field of Search ..... 164/169, 192, 37

[56] References Cited

U.S. PATENT DOCUMENTS

| | | | |
|---|---|---|---|
| 3,238,575 | 3/1966 | Taccone | 164/169 |
| 4,846,253 | 7/1989 | Damm | 164/169 |

FOREIGN PATENT DOCUMENTS

| | | | |
|---|---|---|---|
| 210530 | 6/1984 | German Democratic Rep. | 164/169 |
| WO83/00300 | 2/1983 | PCT Int'l Appl. | 164/169 |
| 982841 | 12/1982 | U.S.S.R. | 164/169 |
| 1031635 | 7/1983 | U.S.S.R. | 164/192 |
| 1210959 | 2/1986 | U.S.S.R. | 164/169 |
| 1386358 | 4/1988 | U.S.S.R. | 164/169 |

*Primary Examiner*—J. Reed Batten, Jr.

*Attorney, Agent, or Firm*—Helfgott & Karas

[57] ABSTRACT

A motor is mounted on a support positioned under a sand-supplying hopper. The motor is provided with sand-stirring vanes and has a protective plate to protect the motor from sand discharges. An air discharge valve is provided annularly outside the hopper and includes an annular plunger which has a dihedral-shaped front face for closing a correspondingly-shaped annular aperture connected to an air source and is displaceably positioned within an annular chamber provided in a support ring of the valve.

5 Claims, 1 Drawing Sheet

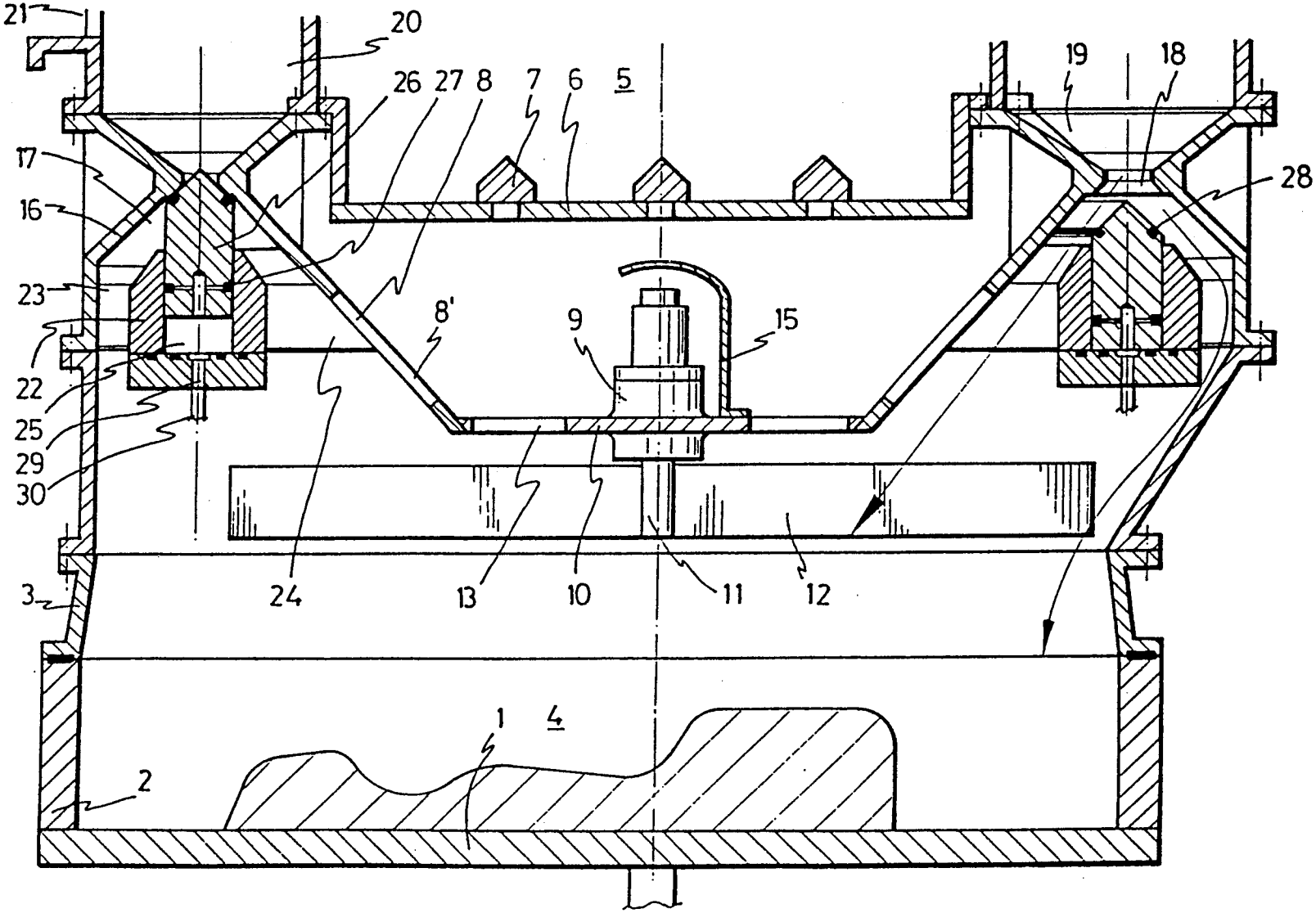
28
18
19
15
12
11
5
6
7
8
27
26
20
9
10
13
8'
24
1
4
2
21
17
16
23
22
25
29
30
3

AIR IMPACT SAND-BOX MOULDING MACHINE

FIELD OF THE INVENTION

The present invention relates to a series of improvements introduced in the machines used to form sand moulds employed in the foundry industry and where sand is compacted by impact of blast air, also called an expansion wave, such air suddenly falling upon the sand accumulated in an exclosure formed by the moulding box and a frame, when a valve, generally called a release valve, opens up instantaneously.

BACKGROUND OF THE INVENTION

It is a well-known fact that machines of this type have a base plate or table supporting a model. Disposed right under the moulding box, such plate, driven by a classic hydraulic mechanism, is capable of vertical upward and downward travel so that in the course of the upward displacement it may couple tightly and perfectly to the moulding box and the latter to the frame, whereupon the moulding box and part of the frame are filled with sand that is subsequently compacted through a sudden discharge of blast air. Downward displacement of the base plate releases the coupling and the moulding box can hence be removed with the mould duly structured inside the same and is substituted by another box, for other work to begin.

These machines are moreover provided with a hopper containing sand that, when loading the moulding box with the necessary amount of sand, must be located above the same and afterwards be removed to leave space available for a cup where the blast air to be released collects, such air being discharged into the compacting enclosure when the valve located on the cup's lower base is opened. It is hence clear that there is a synchronized movement to position, depending on the work stage, the hopper or the cup axially to the moulding box. The cup may sometimes be fixed with the hopper as a moving element, or the other way round, in which case the plate or table supporting the moulding box must be moved horizontally, to be positioned under the sand hopper or under the cup, as appropriate.

The cup where the blast air collects, whether fixed or mobile with regard to the moulding box, is in turn provided with a release valve comprising a tilting metal disc, a deformable or other diaphragm that, when the blast air is discharged, opens and allows it to enter the enclosure defined by the moulding box and the frame instantaneously so as to compact the sand inside such enclosure. As aforesaid, when directing the air, deflectors operatively provided to such end in the diffuser may be used.

Once the air has been released and hence the sand has been compacted, air remaining in the compacting enclosure is removed through a delivery valve that should preferably be positioned far from the moulding box to prevent dragging of highly abrasive sand that would damage whatever installation elements it might come across with when going out.

Machines thus formed, among which there are obviously differences depending on the manufacturer, have certain disadvantages, which are put right using the improvements subject hereof.

In fact, one of the most oustanding disadvantages of current machines derives from the use of the cup where the blast air collects to compact the sand, the lower base of such cup being provided with the release valve, and the cup being positioned axially to the moulding box. With this structure and arrangement, the air clearly and naturally tends to be directed, largely and most efficiently, towards the center of the moulding box, resulting in sand moulds with a density that is barely uniform, i.e., very dense in the middle and less so at the sides and ends, although it is particularly beneficial for a good mould density to be obtained peripherally so as to avoid any damage during handling thereof. This disadvantage, derived from the position of the release valve regarding the moulding box, can be overcome to some extent using deflectors partly deviating the blast air towards the peripheral areas of the compacting enclosure, though their efficiency does not wholly solve the problems.

Another typical disadvantage, that has already been mentioned hereinbefore, is that the hopper or the cup must be mobile in order to be placed above the moulding box when loading the same and when releasing the blast air, this requiring the use of mechanisms and means to make such movements possible and that obviously render the machine more complex and costly.

Yet another disadvantage of some sand-box moulding machines currently used is that the sand from the hopper that fills the moulding box and part of the frame is poorly spread out, for no means are provided to level and spread out the sand within the compacting enclosure, such enclosure comprising, as aforesaid, the tightly coupled moulding box and frame.

SUMMARY OF THE INVENTION

It is an object of the present invention to overcome all the aforesaid problems and, according thereto, the sand-box moulding machine is provided with a sand-supplying hopper placed axially above moulding box. The hopper is fitted with the relevant known hatches to allow sand to fall into the compacting enclosure and, after dumping the sand, close the access.

Right under the hopper there is, likewise axially, a motor to stir the sand filling the moulding box and part of the frame, which motor is mounted on a horizontal support provided with broad apertures allowing sand passage, and fitted with a shielding hood or plate to prevent the falling sand from damaging it. Integral with this motor's shaft are a series of radial vanes, similar in dimension to the frame and moulding box. The rotation of vanes leads to a perfect and even spreading of the sand unloaded into the compacting enclosure, before the air blast is released.

Additionally, as another peculiarity of the invention, and so that the upper and middle area of the machine is left clear for location of the aforesaid elements, the stopper is placed on the perimetral area of the assembly and, with the same classic working mechanism mentioned hereinbefore, i.e., keeping the stopper's closed position at the expense of the actual small boiler storing fluid, a specific practical solution has been taken, wholly different from what is usual albeit with full working efficiency.

Thus, more specifically and according to another embodiment of the invention, the cup-shaped and lower hopper sector is surrounded by an annular aperture for fluid discharge, obviously divided by radial partitions communicating the hopper with the external body, which body in turn has a cup-shaped section counterpoised to the hopper and, between the body and the hopper, a perimetral throat, with a trapezoidal isosceles cross-section, pointing downwards, and the lower and upper base whereof is provided with the communication aperture mentioned hereinbefore.

Within this perimetral and rather large throat there is a ring at quite some distance both from the internal wall and from the external wall of the throat and that is duly connected to the hopper body through radial stays. Such ring is largely provided with a slot of rectangular cross-section, open at the top, closely housing an annular plunger, projecting from the slot and its front being dihedral for the trapezoidal isosceles profile of the aforesaid throat and against which it shall abut, when in the closed position, through the relevant sealing joints.

Between the annular plunger and the ring in which it is housed, specifically at the bottom of the throat, there is a chamber communicating with the pressure supplying boiler, the lower or internal plunger base having a larger surface than the annular aperture for fluid discharge about which the stopper abuts as a closing element so that as the same pressure is exerted at either end of the annular stopping plunger and, as the surface of one of them, specifically the lower surface, is larger, such stopper tends to take up the closed position, whilst when pressure suddenly ceases to be exerted on the lower plunger surface, the plunger suddenly takes up the open position with the ensuing discharge of air towards the sand compacting area.

BRIEF DESCRIPTION OF THE DRAWINGS

The only FIGURE of the drawing shows, in an illustrative and non-limitng manner, a partial side elevation and cross-sectional view of an air impact sand-box moulding machine having the improvements according to the present invention.

DETAILED DESCRIPTION OF THE PREFERRED EMBODIMENTS

Referring now to the drawing in detail, it may be observed that a sand-box moulding machine made with the improvements has, as any usual machine, a plate (1) supporting a model or models, complemented with a box (2) with a revelant frame (3) at its mouth, so that these elements form a moulding chamber (4) which shall initially be filled with sand, mixed with a suitable bond agent, for subsequent compacting thereof on the model, by sudden pneumatic discharge.

Now then, the sand is supplied axially from the above from a hopper (5) provided with a hatch (6) and cross pieces of dihedral section (7) preventing sand accumulations, a cup-shaped section (8) under the hopper (5), having apertures (8') allowing sand to fall towards the moulding chamber (4), which section frames a motor (9) mounted on a support (10), the output shaft (11) of such motor being radially provided with vanes (12) attached thereto, ideally four, that through the rotary movement supplied by the motor (10) duly spread the sand out within the compacting chamber (4), specifically so that the upper plane of the sand mass is horizontal and level with the mouth of the frame (3).

The support (10) is largely provided with broad apertures (13) that may be of any suitable shape, but at all events and because of their large size, allowing sand to fall down swiftly and easily towards the compacting chamber (4), such support (10) being obviously fitted with a central bore (14) for positioning and fixing the motor (9), and at the same time as the actual support (10) is likewise provided with a plate (15) attached to it for protecting the said motor (9) and preventing sand from falling straight onto the latter, as shown in the FIGURE.

Further to these means for supplying and evenly spreading out the sand within the compacting chamber (4), another of the improvements of the invention refers to the machine's pneumatic release and blocking means, that appear closed on the left-hand side of the FIGURE and open on the right-hand side.

More specifically, such means are located level with the hopper's upside down cup-shaped section (8) and outside the same, where a machine body (16) is shaped to form a complement to the aforesaid cup shaped section (8), so that the perimetral area of the machine is provided with a throat (17) of trapezoidal isosceles configuration, topped with a circumferential aperture (18), shaped as a circular crown and through which discharge is effected, another throat (19) being provided above the same, counterpoised to the previous one and from which a likewise annular air manifold (20), which is provided with pressure from the classic boiler and through a side connection (21), effects pneumatic discharge.

The lower throat (17) and, at quite some distance from the walls, is provided with a fixed U-shaped ring (22), with its concavity facing upwards and attached to the body (16) through radial stays (23), at the same time as other stays (24) attach ring 22 to the internal hopper section (8), such ring (22) being largely provided with a wide slot (25), of rectangular cross-section, open upwards, within which plays an annular plunger (26), sealed with respect to the slot (25) through seals (27) and designed to close the valve opening (18), for which purpose it has a dihedral-shaped front, as also duly shown in the FIGURE, fitted with a pair of side joints or seals (28) that respectively abut the inclined planes of section (8) and body (16) of the hopper and of the machine.

The base of the ring (22) is provided with one or several bores (29) to which are coupled respective conduits (30), communicating with the boiler that is not shown in the FIGURE, so that whilst the boiler pressure reaches the dihedral front face of plunger (26), in the position shown on the left-hand side of the FIGURE, this same pressure also reaches the chamber within slot (25) defined between the ring (22) and the stopper (26), wherefore as the surface of the base of the stopper (26) is larger than the surface of the dihedral front thereof, the latter is kept in the said closed position, whilst when the pressure reaching the chamber within slot (25) ceases, for instance communicating with the outside of conduit (30), there is a sudden difference in pressure at opposite ends of the plunger or stopper, leading the same to withdraw almost immediately towards the inside of the ring (22), the valve to open suddenly and moreover the air present inside the manifold (20) to be suddenly discharged towards the surface of the sand present in the compacting chamber (4).

It is not considered necessary to extend the present description any further for a person skilled in the art to understand the scope of the invention and the advantages derived therefrom.

The materials, shape, size, and arrangement of the elements may vary, provided this does not imply a modification in the essence of the characteristics of the invention.

The terms used to describe the present specification should be understood to have a wide and non-limiting meaning.

I claim:

1. In an air impact sand-box moulding machine comprising a machine body, a sand-supplying hopper, a compacting chamber for compacting sand on a model positioned within a moulding box, a frame connected to said body and coupled to a mouth of said box wherein compacting is carried out by sudden pnuematic discharge from a boiler and wherein a valve means is provided including a plunger which is maintained in a closed position due to pressure of the boiler when blast air is not released, the improvement comprising a motor positioned in an upper area of said compacting chamber, said motor including a vertical shaft coaxial with a central axis of said sand-supplying hopper and rotary vanes attached to said shaft and positioned right above said frame which forms with said box said compacting chamber so that said vanes, upon rotation thereof, evenly spread out sand reaching said compacting chamber within said chamber, a metering hatch positioned inside said hopper above said motor, a support plate provided at a mouth of said hopper and supporting said motor, said support plate having apertures for permitting sand to fall therethrough into said compacting chamber, said support plate being provided with a protective plate integrally connected thereto to protect said motor from the sand falling into said compacting chamber upon opening of said metering hatch.

2. The air impact sand-box moulding machine according to claim 1, wherein said body envelops said sand-supplying hopper so as to define therebetween an annular aperture and two throats of trapezoidal isosceles cross-section provided at two opposing sides of said annular aperture, a top throat communicating with an air manifold for supplying air into said compacting chamber and connected to said boiler and a lower throat accommodating said valve means, said valve means further including a ring connected to and supported by stays at a radial distance from walls of said body, said ring having a slot receiving said plunger which is sealingly displaceable therein, said plunger being annular and having a front face of dihedral configuration acting as a stopper when said face cooperates with said annular aperture, said plunger defining in said slot of said ring a chamber connected via conduits to a pressure source whereby a sudden pressure difference can be provided at two ends of said plunger causing said plunger to open suddenly for said sudden pneumatic discharge.

3. The air impact sand-box moulding machine according to claim 2, wherein said slot is of rectangular cross-section.

4. The air impact sand-box moulding machine according to claim 2, wherein said plunger is positioned in said slot by seals.

5. The air impact sand-box moulding machine according to claim 2, wherein annular seals are provided at said front face of said plunger cooperating with said annular aperture.

* * * * *